US007014578B1

(12) United States Patent
Brodeur

(10) Patent No.: US 7,014,578 B1
(45) Date of Patent: Mar. 21, 2006

(54) ADJUSTABLE FOOTBALL GOALPOST ASSEMBLY

(76) Inventor: William Brodeur, 1435 County Route 16, Delhi, NY (US) 13753

( * ) Notice: Subject to any disclaimer, the term of this patent is extended or adjusted under 35 U.S.C. 154(b) by 23 days.

(21) Appl. No.: 10/755,410

(22) Filed: Jan. 13, 2004

(51) Int. Cl.
*A63B 63/00* (2006.01)

(52) U.S. Cl. ..... 473/477; 473/470; 473/476; 473/439

(58) Field of Classification Search ..... 473/420, 473/421, 422, 470–474, 476–478, 439, 438
See application file for complete search history.

(56) References Cited

U.S. PATENT DOCUMENTS 5,429,350 A 7/1995 Meier
6,375,585 B1 * 4/2002 Driscoll ..... 473/477
6,394,917 B1 * 5/2002 Chiappini et al. ..... 473/415

OTHER PUBLICATIONS

Archive Download of Web Page, Sportfield, Dec. 2003, www.sportsfieldspecialties.com, 21 pages.*
SSG Assmbly Instructions, Aug. 1998, 6 pages.*

* cited by examiner

*Primary Examiner*—Eugene Kim
*Assistant Examiner*—M. Chambers
(74) *Attorney, Agent, or Firm*—Mark Levy & Associates

(57) ABSTRACT

A football goalpost that can be used at various times by both high school and college teams by adjusting the spacing of the uprights. The goalpost has the ability to adjust the verticality of the uprights by rotation of the uprights about the crossbar axis. The goalpost has the ability to adjust the side-to-side tilt and front-to-back tilt of the gooseneck by adjusting the gooseneck to sleeve connection. The goalpost also has the ability to adjust the horizontality of the crossbar by rotation of the crossbar about the gooseneck horizontal axis. In addition, the goalpost has a vertical gooseneck with incorporated height adjustment to be used for either real turf, or artificial turf.

19 Claims, 10 Drawing Sheets

ADJUSTABLE FOOTBALL GOALPOST ASSEMBLY

FIELD OF THE INVENTION

The present invention pertains to sports game goalposts and, more particularly, to a goalpost with adjustable spacing of uprights, with adjustable height, and with adjustable verticality thereof.

BACKGROUND OF THE INVENTION

Football is a game in which two opposing teams of 11 players each defend goals at opposite ends of a field having goalposts at each end, with points being scored chiefly by carrying the ball across the opponent's goal line and by place-kicking or drop-kicking the ball over the crossbar between the opponent's goalposts. The football goalposts typically consist of a vertical support member inserted into the ground of the field, with the vertical member transitioning into a horizontal support member, with this portion of the goalpost called a gooseneck. A crossbar is attached at its midpoint to the end of the horizontal portion of the gooseneck, and at each end of the crossbar are attached a horizontal upright member. Field goals and extra points are scored in football by kicking the ball between the two uprights, and over the crossbar.

It is important for the goalpost to fulfill the specification of the football league in which the goalpost will be used. These specifications include definition of the size of the goalpost, including height and width, and also the alignment of the goalpost uprights relative to the geometry of the playing field. The geometry includes the height of the crossbar, the width of the space between the uprights of the goalpost, and the verticality of the uprights relative to the perpendicular football field plane.

A problem arises when the same playing field is to be used by different leagues. This is commonly the case when there is a high school league game using the same field on which college games are played. Because a typical high school league uses an upright width of 23 feet and 4 inches, while typical college leagues use an upright width of 18 feet and 6 inches, goalposts which uprights have the appropriate width must be used. A convenient solution is here presented by the present invention in which goalposts with adjustable spacing of the uprights is provided. As a result, a single goalpost assembly can be changed from one configuration to another, easily and simply.

Another problem has to do with the ability to adjust the upright verticality, the angle relative to the perpendicular football field plane, after the sleeve supporting the crossbar has been installed in the ground. The present invention has a built-in capability to adjust the uprights vertically by rotating them about the horizontal axis at the connection with the crossbar.

DISCUSSION OF RELATED ART

Three prior art patents address uprights with a variety of width modifications, and height and vertical angular correction (i.e., verticality). U.S. Pat. No. 6,394,917, issued to CHIAPPINI, et al., on May 28, 2002, for Goal Posts with Adjustable Components, describes an assembly using a linear actuator, either a rack and pinion system, a pneumatic system, or a hydraulic system to provide a translation mechanism along the crossbar for the adjustment of the width between the two uprights. In addition, CHIAPPINI describes an assembly for adjusting the height, and side-to-side tilt, as well as front-to-back tilt of the supporting gooseneck member. This mechanism is a complex assemblage of a substantial number of parts, and the complexity of the design increases the costs of production and the cost of maintenance, as well as the weight of the entire goalpost structure. The present invention of adaptable uprights uses fewer than half as many parts. Much simpler, more robust and lighter than the prior art, the present invention's manual mechanism is less expensive to manufacture, easier to transport, easier to assemble, and easier to maintain.

U.S. Pat. No. 6,375,585, issued to DRISCOLL, on Apr. 23, 2002, for Adjustable Goalpost Assembly describes a translation mechanism along the crossbar in which each upright is mounted on a trolley and each upright can slide along the crossbar. This prior art does not allow adjusting the upright verticality after insertion of the supporting sleeve in the ground. More over, in regard to the capacity to ensure the stability of the uprights in their non-inclinable vertical position, the trolley used in this prior art is a less robust and heavier mechanism than the present invention.

U.S. Pat. No. 5,429,350, issued to MEIER, on Jul. 4, 1995, for Goal Post Inserts, describes a goalpost assembly with three cylindrical solid inserts for added strength of the goalpost. This invention provides reinforcement for withstanding the stress of victorious fans climbing the goalpost. The described invention does not provide for any adjustment of the spacing of the uprights.

Another concern is about the current existence of two types of playing field: real turf and artificial turf. These two types of playing field have a one and one half inch difference in height. Existing football goalposts require preliminary work on the goalpost prior to delivery to the playing field for assembly, preparing the goalpost assembly for use with either real turf or artificial turf. The present invention permits the mechanical components that constitute the uninstalled goalpost to be assembled on a job site without preceding preparation, for either natural or artificial turf, with necessary adjustments to accommodate the type of turf made at the assembly site.

SUMMARY OF THE INVENTION

In view of the foregoing, an objective of the present invention is to provide football goalposts with adjustable spacing of uprights, to accommodate the requirements of different football leagues.

Another objective of the present invention is to provide goalposts with the verticality of the uprights adjustable by rotation of the connections between the uprights and the crossbar.

Another objective of the present invention is to provide goalposts with adjustable width of the uprights, robust enough to ensure the stability of the uprights in the specified verticality.

Another objective the present invention is to provide goalposts with adjustable uprights, using a simpler, lighter, and less expensive apparatus compared to prior art.

Another objective of the present invention is to provide goalposts with a sleeve inserted in the ground, into which the bottom of the gooseneck is inserted, with an optional riser, which permits the on-site installation of a single version of the assembly with adjustment of height for use with either real turf, or artificial turf.

Another objective of the present invention is to provide goalposts with a sleeve inserted in the ground, into which the bottom of the gooseneck is inserted, wherein the diameter of the sleeve is sufficiently larger than the diameter of the inserted gooseneck, such that the gooseneck's verticality may be adjusted front-to-back and side-to-side, by adjustment of the connection of the top of the sleeve to the gooseneck.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention bear the same designations or numbering throughout the FIGURES.

DETAILED DESCRIPTION OF THE PREFERRED EMBODIMENT

This invention provides goalposts that provide adjustable width of the uprights. This invention provides goalposts that provide the ability to adjust the level of the crossbar, i.e., horizontal angularity, by rotation around the gooseneck to crossbar connection. This invention additionally provides goalposts with adjustable verticality of the uprights by rotation around the horizontal axis of the crossbar. This invention also provides a riser that may be used on the bottom of the gooseneck portion of the goalpost permitting the same assembly to be used either for football played on natural turf or artificial turf, where a height adjustment of one and one half inches is required. This invention also provides an adjustment of the gooseneck verticality by tilting side-to-side and front-to-back, within the sleeve that is inserted into the hole in the field.

Figure 1A:
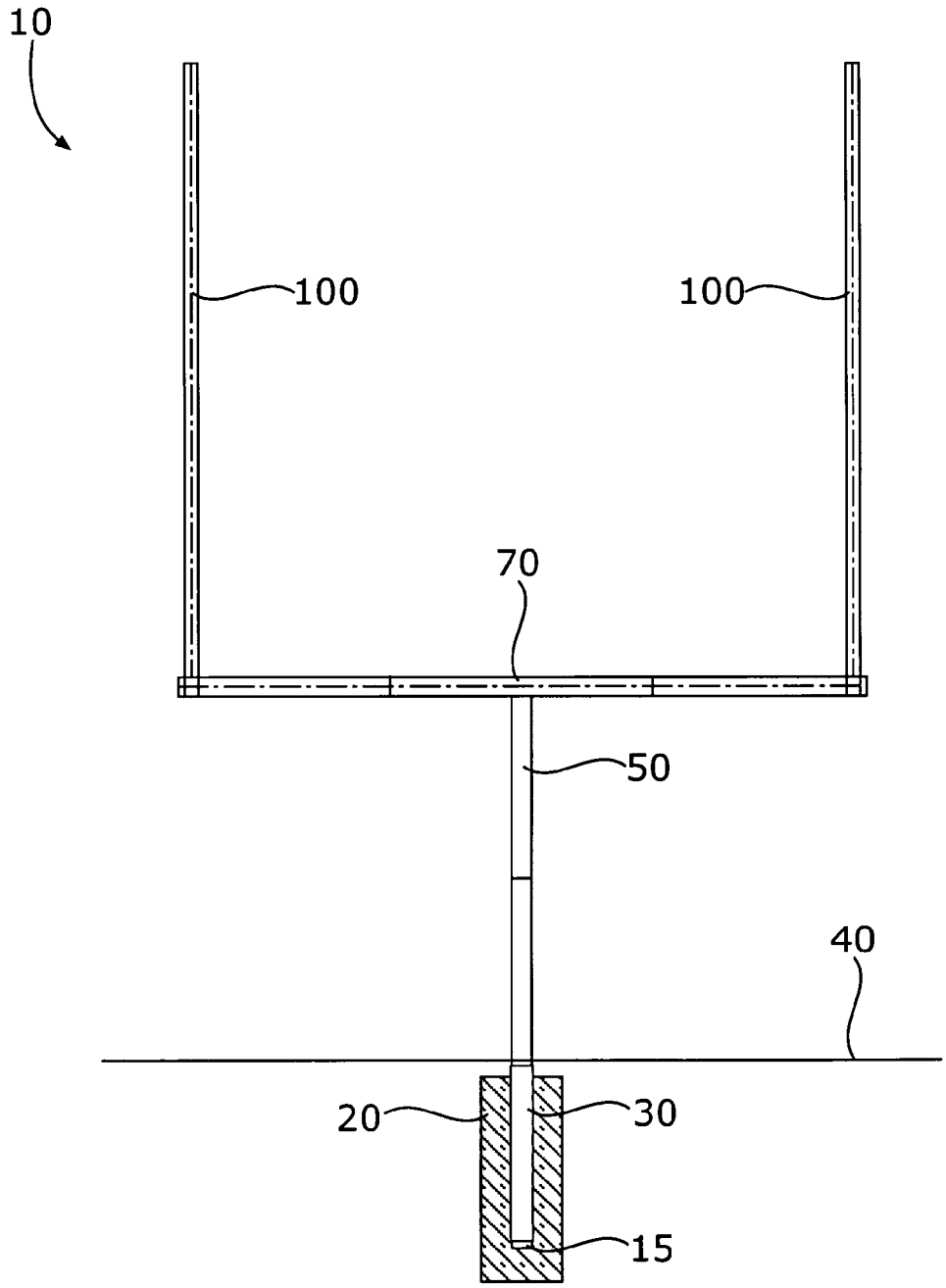
FIG. 1*a* is a front view of the entire goalpost structure, as installed on artificial turf.

The entire goalpost is an assembly of tubes, preferably constructed of aluminum, providing light weight and strength. In the embodiment shown in FIG. 1*a*, the goalpost assembly 10 is shown in a front view. The sleeve 30 is inserted into a hole in the field 20, in the artificial or natural turf 40. The goalpost's gooseneck 50 is then inserted into the sleeve 30. The riser 15 may be used by attachment to the gooseneck 50 before the gooseneck is inserted into the sleeve 30 thus adjusting the height of the gooseneck 50 upward relative to the sleeve 30, for use with artificial turf. An adjustment of one and one half inches upward is typically required, and the riser 15 adds one and one half inch to the vertical length of the gooseneck 50.

Figure 1B:
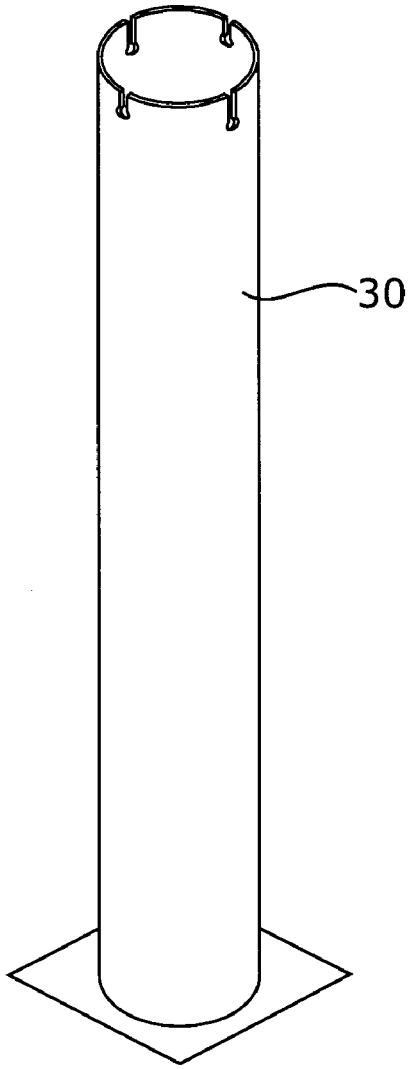
FIG. 1*b* is a perspective view of the sleeve that is placed in a hole in the field.

Referring to FIG. 1*b*, the sleeve 30 that is inserted into the hole in the field is shown. The slots 35 at the top of the sleeve 30 receive bolts and nuts that allow adjustment of the gooseneck 50 in relation to the sleeve 30, in two orthogonal directions. The diameter of the sleeve 30 is larger than the diameter of the gooseneck 50, allowing the adjustment of the verticality of the gooseneck 50 relative to the verticality of the sleeve 30. In a preferred embodiment, the diameter of the sleeve 30 is two inches larger than the diameter of the gooseneck 50, providing a maximum adjustment of two inches over a typical sleeve 30 length of sixty inches. Other acceptable dimensions will be readily apparent to those skilled in the art, and are included in the scope of this invention.

Figure 1C:
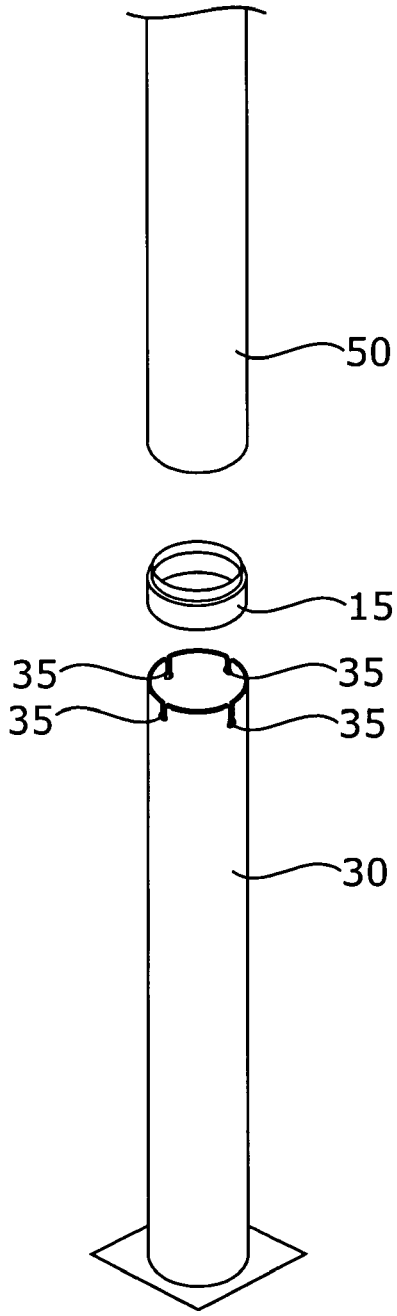
FIG. 1*c* is a perspective exploded view of the sleeve, the riser, and the bottom of the gooseneck.

Referring to FIG. 1*c*, an exploded view of the sleeve 30, the riser 15, and the gooseneck 50 is shown. Again, the diameter of the sleeve 30 is larger than the diameter of the gooseneck 50, providing an adjustment of the verticality of the gooseneck 50 relative to the verticality of the sleeve 30.

Figure 2:
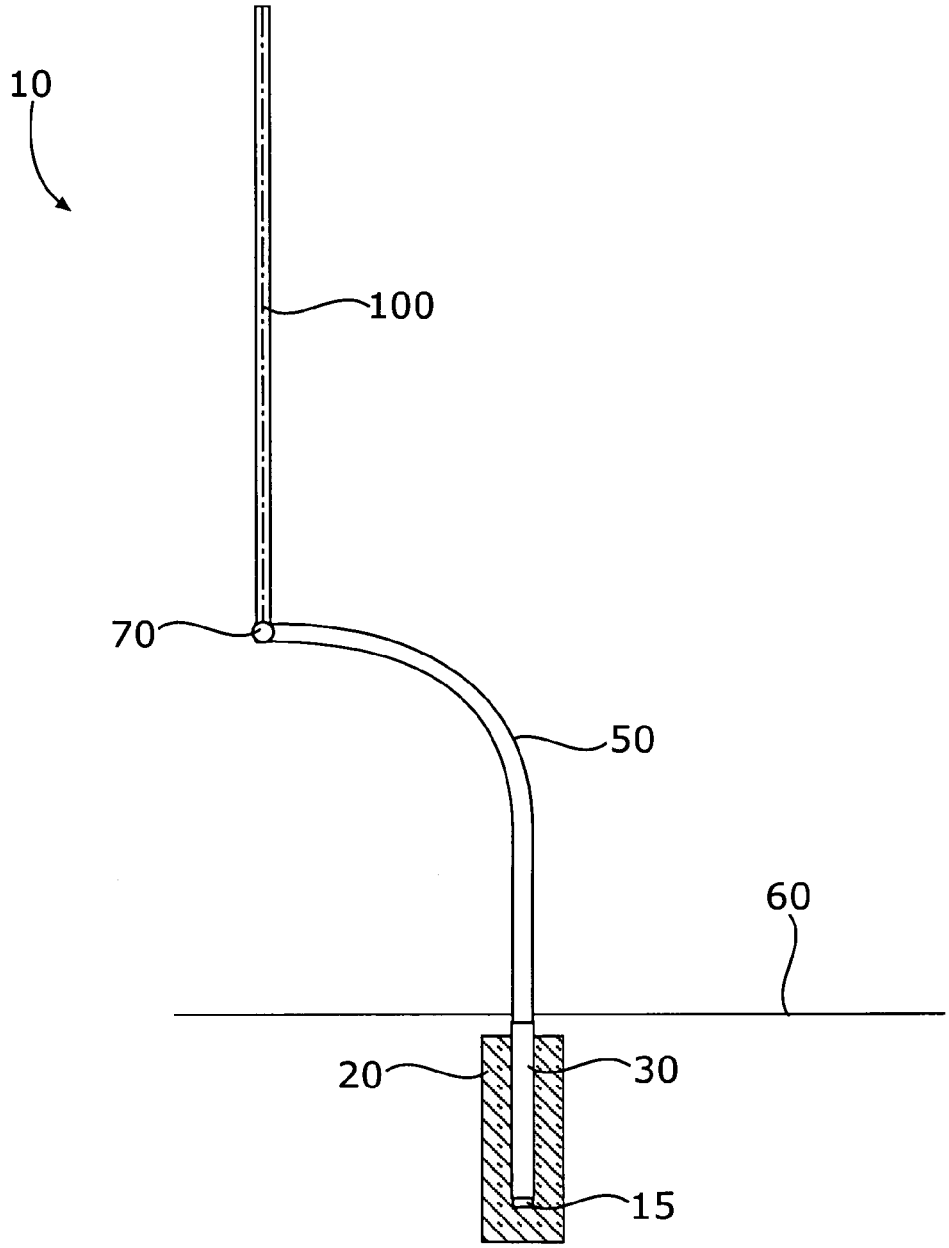
FIG. 2 is the side view of the same goalpost structure as installed on the artificial turf, with the sleeve in the one and one half inch vertically extended position as a result of the use of the riser.

Referring to FIG. 2, the goalpost assembly 10 is installed on real turf 20 and the sleeve 30 is in the one and one half inch extended position. Again, the gooseneck 50 of the goalpost assembly 10 is inserted into the sleeve 30, which is inserted into a hole 20 in the field, in the real turf 60. The others elements of the design are identical for the two embodiments.

Figure 3A:
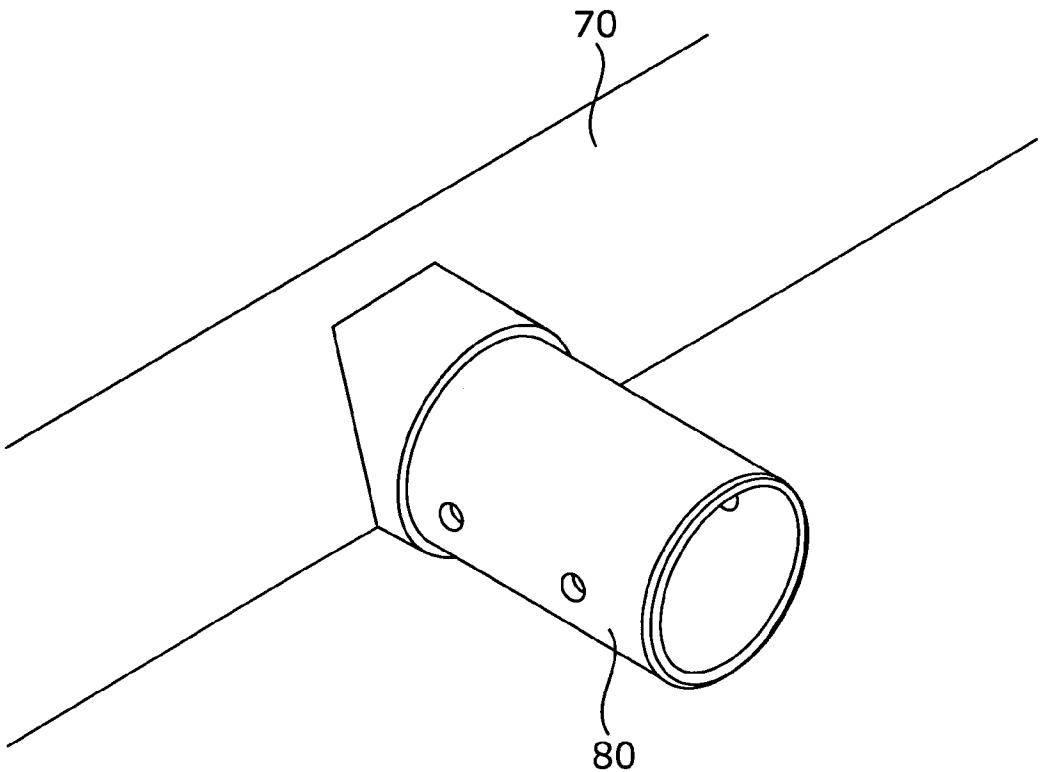
FIG. 3*a* is the perspective view of the gooseneck mount as welded on the crossbar.
Figure 3B:
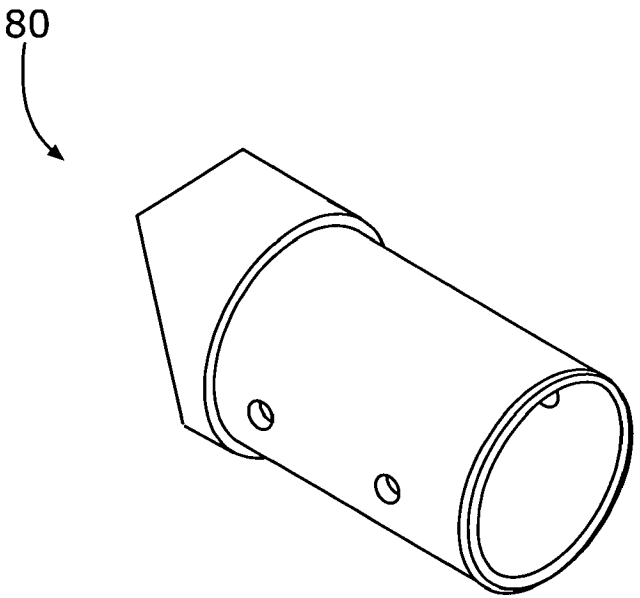
FIG. 3*b* is the perspective view of the gooseneck mount as an individual part, before attachment to the crossbar.

Referring to FIG. 3*a*, and FIG. 3*b*, a mount 80 shown individually on FIG. 3*b*, is shown welded at the middle of the crossbar 70, in FIG. 3*a*.

Figure 4:
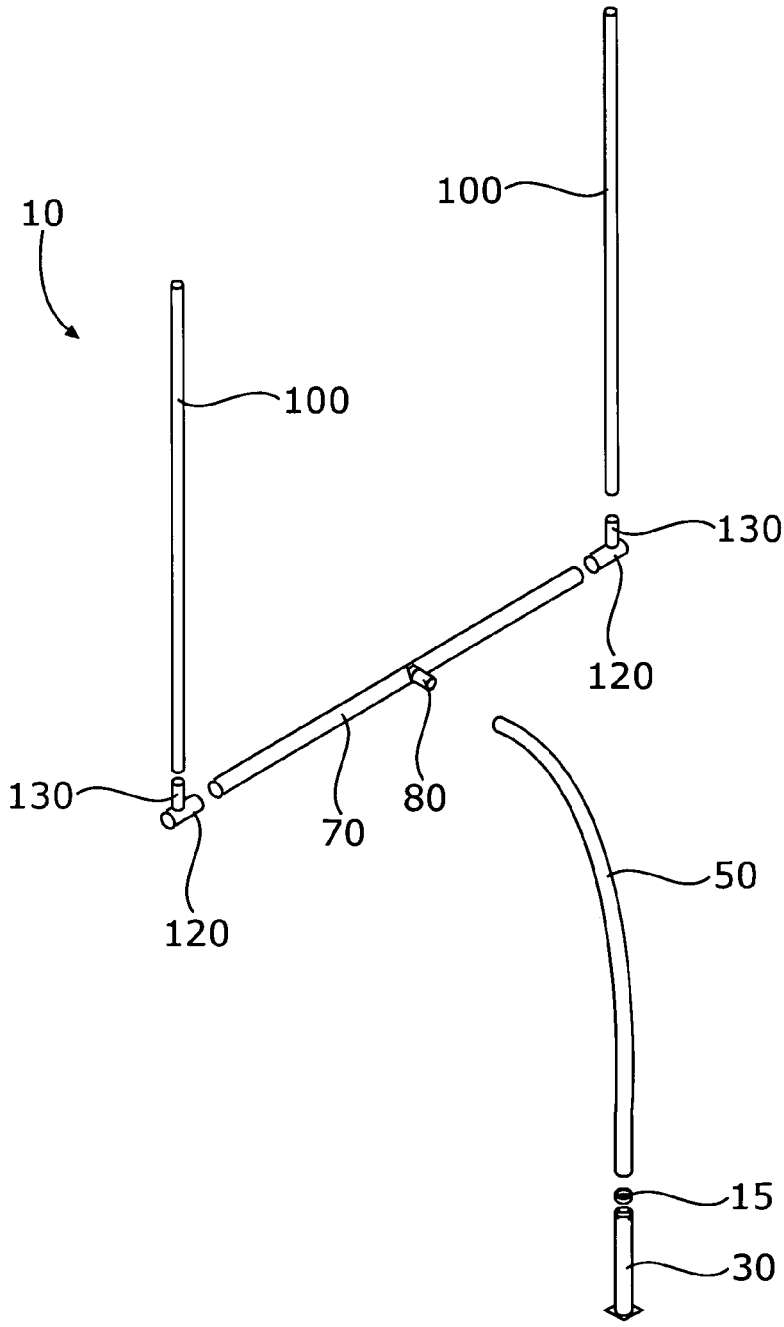
FIG. 4 is the perspective exploded view of the entire goalpost structure and the gooseneck, in an alternate embodiment with a predetermined and non-adjustable width.

Referring to FIG. 4, the upper end of the gooseneck 50 is then inserted into the mount 80 to support the crossbar 70. After the crossbar has been leveled horizontally by rotational adjustment about the axis of gooseneck 50, the crossbar 70 is immobilized in that position by inserting bolts into preexisting matching holes in the gooseneck 50 and the cylindrical end of the mount 80, and tightening these bolts snugly. The crossbar is then pinned in place by drilling a hole in the mount 80 through the pre-drilled hole in the mating end of the gooseneck 50, and tapping in place a rollpin 210. The gooseneck 50 is on a plane perpendicular to the horizontal crossbar 70.

Figure 5:
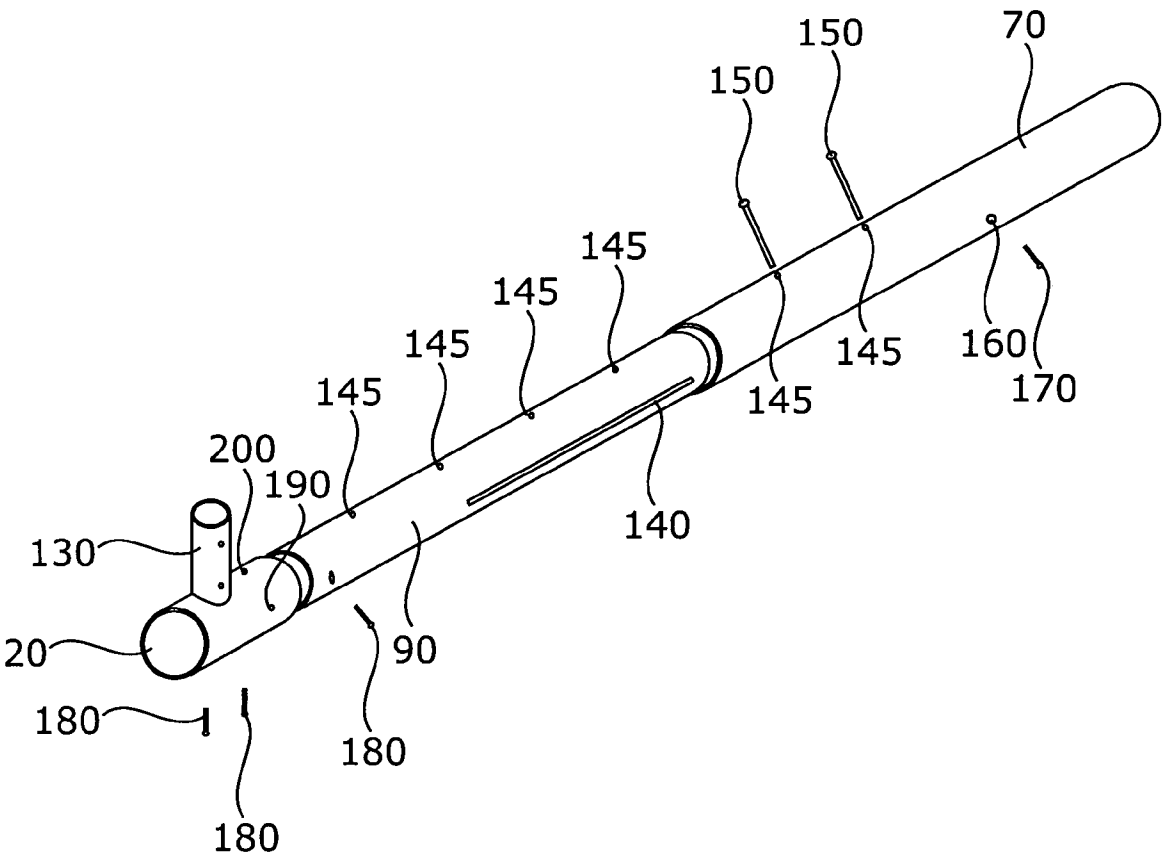
FIG. 5 shows an exploded view of the disassembled upright width adjustment mechanism.

Referring to FIG. 5, each of the 2 extreme ends of the crossbar 70 has holes 145 to match up with the holes 145 on the crossbar insert 90. The uprights 100 spacing will be adjusted by inward or outward motion of the crossbar insert 90 along the inside diameter of the crossbar 70. The moving sleeves will be restrained to a rectilinear motion by an anti-rotation pin 170 inserted through a hole 160 on the crossbar 70 into the slot 140 on the crossbar insert 90. As soon as the uprights 100 spacing has been adjusted either at 23 feet and 4 inches for high school football games or at 18 feet and 6 inches for college football games, two bolts 150 are inserted through the holes 145 to immobilize the crossbar insert 90.

Figure 6:
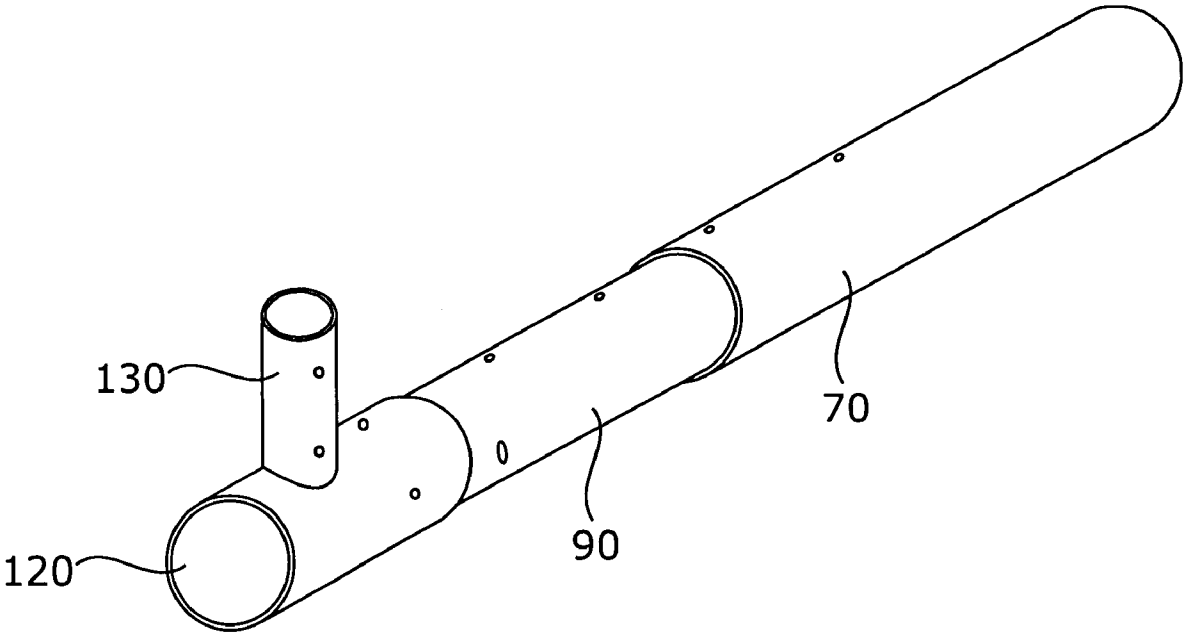
FIG. 6 shows the mechanism of upright width adjustment after being adjusted to the wider width, corresponding to the High School configuration of the goalpost.

FIG. 6 shows the assembled upright width adjustment mechanism after being adjusted to the wider width.

Figure 7:
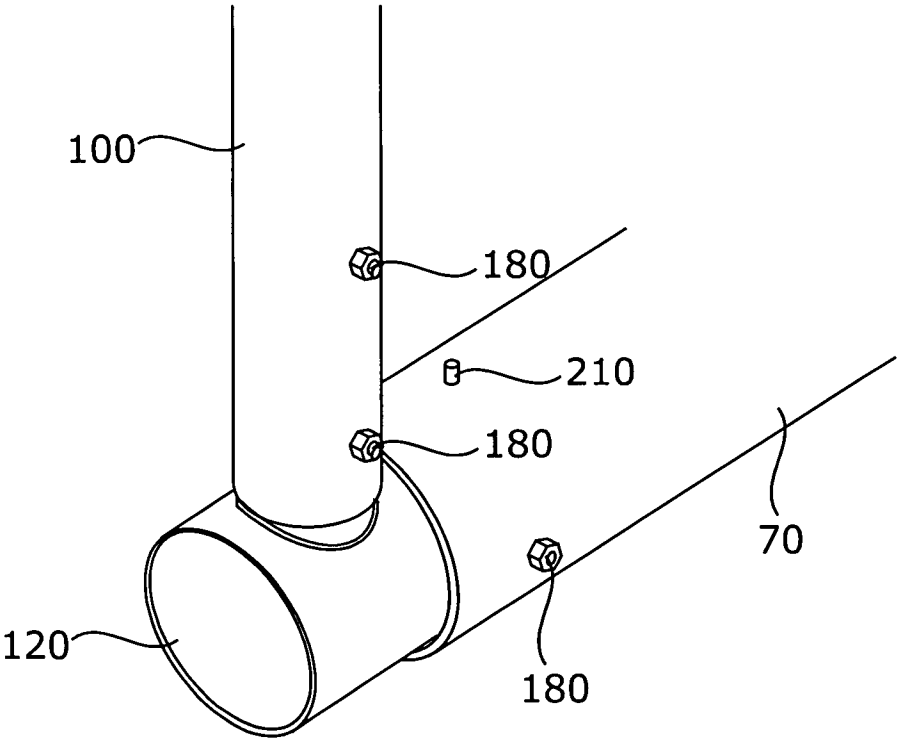
FIG. 7 shows the upright as assembled to the rest of the goalpost structure, in an alternative embodiment with a predetermined and non-adjustable width.

Referring now to FIG. 7, the uprights 100 are joined to the sleeve by two end caps 120, each of which end caps 120 include the upright mating sleeve 130. Each upright 100 slides over the upright mating sleeve 130, and is bolted in place. The verticality of the uprights 100, i.e., the angle of the uprights 100 relative to a plane parallel to the sides of the field and perpendicular to the plane of the field, is adjusted by angular motion of the end cap 120 about the axis of crossbar insert 90. The end cap is then immobilized in the adjusted position by inserting threaded bolts 180 into holes 190, and tightening snugly. Finally, a hole is drilled into the end cap and crossbar insert 90, and a roll pin 210 is tapped in place, to maintain the verticality of the uprights. FIG. 7 shows the alternative embodiment with a predetermined and non-adjustable width also shown in FIG. 4.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of the invention.

The invention claimed is:

1. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve, and said gooseneck post having means located at said proximal end of said gooseneck post for adjusting the length thereof;

c) a horizontal member operatively connected to the distal end of said vertical gooseneck post at an intermediate point of said horizontal member, the angle of said horizontal member relative to said plane of said playing field being adjustable;

d) a pair of uprights, each operatively connected to respective ends of said horizontal member; and e) said horizontal member having means for adjusting the distance between each of said pair of uprights and means for adjusting verticality of said pair of uprights f) said means for adjusting the length of said gooseneck post further comprises a riser operatively connected to said proximal end of said gooseneck post g) wherein said connection enabling the front-to-back and side-to-side adjustment of the verticality of said gooseneck post relative to the verticality of said sleeve further comprises bolts and nuts for attachment and adjustment of said connection in two orthogonal directions.

2. The goalpost in accordance with claim 1, wherein said means for adjusting said angle of said horizontal member relative to said plane of said playing field further comprises a gooseneck mount rotatively attached to said distal end of said vertical gooseneck post; said adjustment means including bolts and a pin to prevent said horizontal member from rotating relative to said distal end of said vertical gooseneck post after adjustment.

3. The goalpost in accordance with claim 2, wherein said operative connection for adjusting the distance between each of said pair of uprights comprises:

i) a horizontal member insert having a longitudinal slot, said horizontal member insert being connected to said horizontal member and having a diameter smaller than the diameter of said horizontal member;

ii) an anti-rotation pin inserted through said horizontal member into said longitudinal slot, allowing sliding motion of said horizontal member insert relative to said horizontal member while preventing rotation of said horizontal member insert relative to said horizontal member; and iii) fastening means for locking said horizontal member insert in extended or contracted position relative to said horizontal member.

4. The goalpost in accordance with claim 3, wherein said operative connection between said uprights and said ends of said horizontal member further comprise end caps adjustably attached to said horizontal member insert, each of said end caps comprising:

n) a closed proximal end and an open distal end;

nn) an operatively attached upright mating sleeve perpendicular to the longitudinal axis of each of said end caps, said mating sleeve having a diameter smaller than the inside diameter of said upright;

nnn) fastening means for locking said uprights to said upright mating sleeves after placement of said uprights over said upright mating sleeves; and nnnn) a rotative attachment means disposed between said distal end of said end cap and said horizontal member insert wherein said rotative attachment means comprises bolts and a pin preventing said end cap from rotating relative to said horizontal member insert after adjustment.

5. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve, and said gooseneck post having means located at said proximal end of said gooseneck post for adjusting the length thereof;

c) a horizontal member operatively connected to the distal end of said vertical gooseneck post at an intermediate point of said horizontal member, the angle of said horizontal member relative to said plane of said playing field being adjustable;

d) a pair of uprights, each operatively connected to respective ends of said horizontal member; and e) said horizontal member having means for adjusting verticality of said pair of uprights f) said means for adjusting the length of said gooseneck post further comprises a riser operatively connected to said proximate end of said gooseneck post g) said connection enabling the front-to-back and side-to-side adjustment of the verticality of said gooseneck post relative to the verticality of said sleeve further comprises bolts and nuts for attachment and adjustment of said connection in two orthogonal directions.

6. The goalpost in accordance with claim 5, wherein said means for adjusting said angle of said horizontal member relative to said plane of said playing field further comprises a gooseneck mount rotatively attached to said distal end of said vertical gooseneck post; said adjustment means including bolts and a pin to prevent said horizontal member from rotating relative to said distal end of said vertical gooseneck post after adjustment.

7. The goalpost in accordance with claim 6, wherein said operative connection between said uprights and said ends of said horizontal member further comprise end caps adjustably attached to said horizontal member, each of said end caps comprising:

i) a closed proximal end and an open distal end;

ii) an operatively attached upright mating sleeve perpendicular to the longitudinal axis of each of said end caps, said mating sleeve having a diameter smaller than the inside diameter of said upright;

iii) fastening means for locking said uprights to said upright mating sleeves after placement of said uprights over said upright mating sleeves; and iv) a rotative attachment disposed between said distal end of said end cap and said horizontal member wherein said adjustment means comprises bolts and a pin preventing said end cap from rotating relative to said horizontal member after adjustment.

8. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve;

c) a horizontal member operatively connected to the distal end of said vertical gooseneck post at an intermediate point of said horizontal member, the angle of said horizontal member relative to said plane of said playing field being adjustable;

d) a pair of uprights, each operatively connected to respective ends of said horizontal member; and e) said horizontal member having means for adjusting the distance between each of said pair of uprights and having means for adjusting verticality of said pair of uprights f) said connection enabling the front-to-back and side-to-side adjustment of the verticality of said gooseneck post relative to the verticality of said sleeve further comprises bolts and nuts for attachment and adjustment of said connection in two orthogonal directions g) said means for adjusting said angle of said horizontal member relative to said plane of said playing field further comprises a gooseneck mount rotatively attached to said distal end of said vertical gooseneck post; said adjustment means comprising bolts and a pin to prevent said horizontal member from rotating relative to said distal end of said vertical gooseneck post after adjustment.

9. The goalpost in accordance with claim 8, wherein said operative connection for adjusting the distance between each of said pair of uprights comprises:

i) a horizontal member insert having a longitudinal slot, said horizontal member insert being connected to said horizontal member and having a diameter smaller than the diameter of said horizontal member;

ii) an anti-rotation pin inserted through said horizontal member into said longitudinal slot, allowing sliding motion of said horizontal member insert relative to said horizontal member while preventing rotation of said horizontal member insert relative to said horizontal member; and iii) fastening means for locking said horizontal member insert in extended or contracted position relative to said horizontal member.

10. The goalpost in accordance with claim 9, wherein said operative connection between said uprights and said ends of said horizontal member further comprises end caps adjustably attached to said horizontal member insert, each of said end caps comprising:

n) a closed proximal end and an open distal end;

nn) an operatively attached upright mating sleeve perpendicular to the length of each of said end caps, said mating sleeve having a diameter smaller than the inside diameter of said upright;

nnn) fastening means for locking said uprights to said upright mating sleeves after placement of said uprights over said upright mating sleeves; and nnnn) a rotative attachment between said distal end of said end cap and said horizontal member insert wherein said adjustment means comprises bolts and a pin preventing said end cap from rotating relative to said horizontal member insert after adjustment.

11. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve;

c) a horizontal member operatively connected to the distal end of said vertical gooseneck post at an intermediate point of said horizontal member, the angle of said horizontal member relative to said plane of said playing field being adjustable;

d) a pair of uprights, each operatively connected to respective ends of said horizontal member; and e) said horizontal member having means for adjusting verticality of said pair of uprights f) said connection enabling the front-to-back and side-to-side adjustment of the verticality of said gooseneck post relative to the verticality of said sleeve further comprises bolts and nuts for attachment and adjustment of said connection in two orthogonal directions g) said means for adjusting said angle of said horizontal member relative to said plane of said playing field further comprises a gooseneck mount rotatively attached to said distal end of said vertical gooseneck post; said adjustment means comprises bolts and a pin to prevent said horizontal member relative to said plane of said playing field further comprises a gooseneck mount rotatively attached to said distal end of said vertical gooseneck post; said adjustment means comprises bolts and a pin to prevent said horizontal member from rotating relative to said distal end of said vertical gooseneck post after adjustment.

12. The goalpost in accordance with claim 11, wherein the operative connection between said uprights and said ends of said horizontal member further comprise end caps adjustably attached to said horizontal member, each of said end caps comprising:

a) a closed proximal end and an open distal end;

b) an operatively attached upright mating sleeve substantially perpendicular to the length of each of said end caps, said mating sleeve having a diameter smaller than the inside diameter of said upright;

c) fastening means for locking said uprights to said upright mating sleeves after placement of said uprights over said upright mating sleeves; and d) a rotative attachment disposed between said distal end of said end cap and said horizontal member wherein said adjustment means comprises bolts and a pin preventing said end cap from rotating relative to said horizontal member after adjustment.

13. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve, and said gooseneck post having means located at said proximal end of said gooseneck post for adjusting the length thereof;

c) a horizontal member operatively connected to the distal end of said vertical gooseneck post at an intermediate point of said horizontal member, the angle of said horizontal member relative to said plane of said playing field being adjustable;

d) a pair of uprights, each operatively connected to respective ends of said horizontal member; and e) said horizontal member having means for adjusting the distance between each of said pair of uprights f) said means for adjusting the length of said gooseneck post further comprises a riser operatively connected to said proximal end of said gooseneck post g) said connection enabling the front-to-back and side-to-side adjustment of the verticality of said gooseneck post relative to the verticality of said sleeve further comprises bolts and nuts for attachment and adjustment of said connection in two orthogonal directions h) said means for adjusting said angle of said horizontal member relative to said plane of said playing field further comprises a gooseneck mount rotatively attached to said distal end of said vertical gooseneck post; said adjustment means including bolts and a pin to prevent said horizontal member from rotating relative to said distal end of said vertical gooseneck post after adjustment.

14. The goalpost in accordance with claim 13, wherein said operative connection for adjusting the distance between each of said pair of uprights comprises:

i) a horizontal member insert having a longitudinal slot, said horizontal member insert being connected to said horizontal member and having a diameter smaller than the diameter of said horizontal member;

ii) an anti-rotation pin inserted through said horizontal member into said longitudinal slot, allowing sliding motion of said horizontal member insert relative to said horizontal member while preventing rotation of said horizontal member insert relative to said horizontal member; and iii) fastening means for locking said horizontal member insert in extended or contracted position relative to said horizontal member.

15. The goalpost in accordance with claim 14, wherein said operative connection between said uprights and said ends of said horizontal member further comprise end caps attached to said horizontal member insert, each of said end caps comprising:

n) a closed proximal end and an open distal end;

nn) an operatively attached upright mating sleeve perpendicular to the longitudinal axis of each of said end caps, said mating sleeve having a diameter smaller than the inside diameter of said upright; and nnn) fastening means for locking said uprights to said upright mating sleeves after placement of said uprights over said upright mating sleeves, wherein said fastening means comprises bolts.

16. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve, and said gooseneck post having means located at said proximal end of said gooseneck post for adjusting the length thereof;

c) a horizontal member operatively connected to the distal end of said vertical gooseneck post at an intermediate point of said horizontal member, the angle of said horizontal member relative to said plane of said playing field being adjustable; and d) a pair of uprights, each operatively connected to respective ends of said horizontal member e) said means for adjusting the length of said gooseneck post further comprises a riser operatively connected to said proximal end of said gooseneck post f) said connection enabling the front-to-back and side-to-side adjustment of the verticality of said gooseneck post relative to the verticality of said sleeve further comprises bolts and nuts for attachment and adjustment of said connection in two orthogonal directions g) said means for adjusting said angle of said horizontal member relative to said plane of said playing field further comprises a gooseneck mount rotatively attached to said distal end of said vertical gooseneck post; said adjustment means including bolts and a pin to prevent said horizontal member from rotating relative to said distal end of said vertical gooseneck post after adjustment.

17. The goalpost in accordance with claim 16, wherein said operative connection between said uprights and said ends of said horizontal member further comprise end caps attached to said horizontal member, each of said end caps comprising:

i) a closed proximal end and an open distal end;

ii) an operatively attached upright mating sleeve perpendicular to the longitudinal axis of each of said end caps, said mating sleeve having a diameter smaller than the inside diameter of said upright; and iii) fastening means for locking said uprights to said upright mating sleeves after placement of said uprights over said upright mating sleeves, wherein said fastening means comprises bolts.

18. A goalpost for use on a playing field having a plane, said goalpost having a pair of uprights and a horizontal member for the support thereof, comprising:

a) a vertical sleeve for inserting into a hole in the playing field;

b) a vertical gooseneck post operatively connected to the distal end of said vertical sleeve, said connection enabling the front-to-back and side-to-side adjustment of the verticality of said gooseneck post relative to the verticality of said sleeve;

c) a horizontal member operatively connected to the distal end of said vertical gooseneck post at an intermediate point of said horizontal member, the angle of said horizontal member relative to said plane of the playing field being adjustable; and d) a pair of uprights, each operatively connected to respective ends of said horizontal member e) said connection enabling the front-to-back and side-to-side adjustment of the verticality of said gooseneck post relative to the verticality of said sleeve further comprises bolts and nuts for attachment and adjustment of said connection in two orthogonal directions f) said means for adjusting said angle of said horizontal member relative to said plane of said playing field further comprises a gooseneck mount rotatively attached to said distal end of said vertical gooseneck post; said adjustment means including bolts and a pin to prevent said horizontal member from rotating relative to said distal end of said vertical gooseneck post after adjustment.

19. The goalpost in accordance with claim 18, wherein said operative connection between said uprights and said ends of said horizontal member further comprise end caps attached to said horizontal member, each of said end caps comprising:

i) a closed proximal end and an open distal end;

ii) an operatively attached upright mating sleeve perpendicular to the longitudinal axis of each of said end caps, said mating sleeve having a diameter smaller than the inside diameter of said upright; and iii) fastening means for locking said uprights to said upright mating sleeves after placement of said uprights over said upright mating sleeves, wherein said fastening means comprises bolts.

* * * * *